US005651238A

United States Patent [19]

Belec et al.

[11] Patent Number: 5,651,238

[45] Date of Patent: Jul. 29, 1997

[54] APPARATUS AND METHOD FOR VARIABLE OPENING OF ENVELOPES

[75] Inventors: Eric A. Belec, Southbury; Mary Jo F. Brigiante-Murphy, Shelton; William J. Wright, Killingworth, all of Conn.

[73] Assignee: Pitney Bowes Inc., Stamford, Conn.

[21] Appl. No.: 573,820

[22] Filed: Dec. 18, 1995

Related U.S. Application Data

[63] Continuation-in-part of Ser. No. 358,059, Dec. 19, 1994, abandoned, which is a continuation of Ser. No. 84,908, Jul. 2, 1993, abandoned.

[51] Int. Cl.[6] ..... B65B 59/02; B65B 43/30; B65B 57/00

[52] U.S. Cl. ..... 53/504; 53/284.3; 53/381.6; 53/492

[58] Field of Search ..... 53/504, 501, 468, 53/469, 284.3, 569, 460, 206, 381.6, 381.5, 492

[56] References Cited

U.S. PATENT DOCUMENTS

| | | | |
|---|---|---|---|
| 3,872,644 | 3/1975 | Giraudi et al. | 53/504 X |
| 4,835,941 | 6/1989 | Torii et al. | 53/386.1 X |
| 5,125,214 | 6/1992 | Orsinger et al. | 53/284.3 X |
| 5,321,624 | 6/1994 | Helffrich et al. | 53/504 X |
| 5,408,811 | 4/1995 | Satake | 53/284.3 X |
| 5,447,015 | 9/1995 | Belec et al. | 53/284.3 X |
| 5,467,577 | 11/1995 | Sato | 53/284.3 X |
| 5,556,086 | 9/1996 | Munneke et al. | 53/504 X |

*Primary Examiner*—James F. Coan
*Attorney, Agent, or Firm*—Robert H. Whisker; Melvin J. Scolnick

[57] ABSTRACT

Apparatus and method for variable opening of an envelope is disclosed. The apparatus includes a device for supporting the front panel and flap of an envelope in a plane, and a vacuum bar assembly situated above the supporting device, the assembly having a vacuum cup for gripping the back panel of the envelope. The apparatus includes a device for moving the vacuum cup downward to grip the envelope back panel and to move the cup upward a predetermined distance whereby the back panel is separated from the front panel to thereby open the envelope a predetermined amount. The apparatus also includes a measuring system for measuring the thickness of successive collations, and means responsive to the measuring system for controlling the amount of movement of the vacuum cups so that the predetermined amount of movement thereof varies from envelope to envelope to open each successive envelope only the amount required to accept the collation intended for that envelope.

9 Claims, 7 Drawing Sheets

APPARATUS AND METHOD FOR VARIABLE OPENING OF ENVELOPES

CROSS REFERENCE TO OTHER APPLICATIONS

This application is a continuation-in-part of application Ser. No. 08/358,059, filed Dec. 19, 1994, now abandoned, which is a continuation of application Ser. No. 08/084,908, filed Jul. 2, 1993, now abandoned.

BACKGROUND OF THE INVENTION

The instant invention relates to an apparatus for inserting documents into envelopes, and more particularly to a mechanism for opening the throats of the envelopes preparatory to documents being inserted into the envelopes.

Apparatus for inserting documents into envelopes is well known. In order to enable documents to be inserted into an envelope, the flap of the envelope must be secured away from the throat of the envelope and the throat needs to be opened (i.e., the front and back panels need to be separated) a requisite amount. There are various techniques which are employed in inserting machines for opening the throat of an envelope, one of which involves the use of vacuum cups to grip the back panel of the envelope and lift it away from the front panel which, together with the flap, is restrained in an inserting position by mechanical devices. Vacuum cups are connected to tubes which are mounted on a support bar which is rotated towards the back panel of the envelope waiting therebelow. Once the vacuum cups reach the envelope, a vacuum is applied and the cups grip the back panel of the envelope. The support bar is then rotated away from the front panel of the envelope, which causes the back panel to be separated from the front panel, thereby opening the throat of the envelope.

In prior art vacuum cup envelope opening devices, the vacuum cups are rotated a predetermined distance away from the front panel of the envelope, regardless of the thickness of the collation to be inserted into the envelope. The fixed amount of rotation results in the vacuum cups, in many instances, moving a greater distance than is necessary, i.e., unnecessary motion, and excessive distortion of the envelope. This is a significant disadvantage of prior art envelope opening devices of this type for the reason that excessive distortion of envelopes resulting from opening the throats too wide is a principal cause of jamming while the collations are being inserted. The less an envelope throat is opened, the less the front and back panels, especially the back panel which is lifted, are distorted, and correspondingly, the less likelihood there is for the collations to jam while being inserted into the envelope.

Thus, there is a need for a vacuum cup envelope opening device that overcomes the foregoing problems by providing a method and apparatus for moving the vacuum cups only the requisite distance for the thickness of the collation to be inserted into an envelope, thereby eliminating excess motion of the vacuum cups and distorting the envelope no more than is absolutely necessary.

SUMMARY OF THE INVENTION

The present invention at least obviates if not entirely eliminates the disadvantages of prior art envelope opening mechanisms by providing an apparatus which opens the throats of successive envelopes disposed at an inserting location a predetermined amount that varies from envelope to envelope in accordance with the thickness of the collations that are to be inserted into the successive envelopes. The present invention is adapted for use in an inserting machine having means for opening the throats of successive envelopes fed to an inserting location to receive a collation therein and means for inserting a collation into each opened envelope.

In this environment, the present invention is an apparatus for ascertaining the thickness of successive collations and for opening the throats of successive envelopes a predetermined amount that varies from envelope to envelope in accordance with the thickness of the collations to be inserted into the envelopes. The apparatus comprises means for supporting successive envelopes at an inserting location, movable vacuum means disposed at the inserting location for opening the throats of envelopes, and actuator means for moving the vacuum means. The apparatus further includes means for ascertaining the thickness of successive collations to be inserted into successive envelopes supported at the inserting location, and for generating data indicative of the thickness of each successive collation. Further, there is a control means responsive to the data for controlling the actuating means to open the throats of successive envelopes a predetermined amount which varies in accordance with the thickness of the successive collations to be inserted therein, whereby each successive envelope supported at the inserting location is opened a predetermined amount depending on the thickness of the collation to be inserted into the particular envelope.

In some of its more limited aspects, the actuator means comprises a stepper motor connected to the vacuum means for moving the vacuum means a predetermined increment of movement in response to a predetermined increment of rotation of the stepper motor. The means for ascertaining the thickness of the successive collations includes means for generating data indicative of the thickness of the successive collations and for transmitting that data to the control means. The control means comprises processor means for converting the data into electrical pulses capable of driving the stepper motor through a number of increments of rotation sufficient to move the vacuum means a predetermined distance to open successive envelopes only an amount required to accept the collations to be inserted into successive envelopes.

There are two embodiments of the means for ascertaining the thickness of successive collations, one being a means for measuring the physical thickness of the collations prior to the collations being inserted into the envelopes. The other is a computer processing means for calculating the thickness of the successive collations from data previously stored in the computer processing means which is indicative of various characteristics of the successive collations. In the latter case, the computer processing means includes means for printing an indicia, such as a bar code, on at least one sheet of each of the successive collations that is indicative of the thickness of the collations, and there is a reader capable of reading the indicia.

The instant invention also provides a method of ascertaining the thickness of successive collations and for opening the throats of successive envelopes a predetermined amount that varies from envelope to envelope in accordance with the thickness of the collations that are to be inserted into the envelopes. The method comprises the steps of supporting successive envelopes at an inserting location and moving a vacuum means disposed at the inserting location into contact with the back panels of the envelopes for gripping the back panels of the envelopes. The method further comprises the steps of ascertaining the thickness of successive collations to be inserted into successive envelopes supported at the inserting location, generating data indicative of the thickness of each successive collation, and moving the vacuum means away from the envelopes by a predetermined amount which varies in accordance with the data indicative of the thickness of the successive collations, whereby each successive envelope supported at the inserting location is opened a predetermined amount depending on the thickness of the collation to be inserted into a particular envelope.

Having briefly described the general nature of the present invention, it is a principal object thereof to provide an improved envelope inserting machine in which the throats of envelopes are opened only by an amount sufficient to accept a collation to be inserted into the envelope to maintain distortion on the envelopes at a minimum.

It is another object of the present invention to provide an apparatus for ascertaining the thickness of successive collations in an inserting machine and for opening the throats of successive envelopes a predetermined amount that varies from envelope to envelope in accordance with the thickness of the collations to be inserted into the envelopes.

It is still another object of the present invention to provide a method of ascertaining the thickness of successive collations and for opening the throats of successive envelopes a predetermined amount that varies from envelope to envelope in accordance with the thickness of the collations that are to be inserted into the envelopes.

These and other objects and advantages of the present invention will become more apparent from an understanding of the following detailed description of presently preferred embodiments of the invention when considered in conjunction with the accompanying drawings.

DETAILED DESCRIPTION OF THE PREFERRED EMBODIMENT

Figure 1:
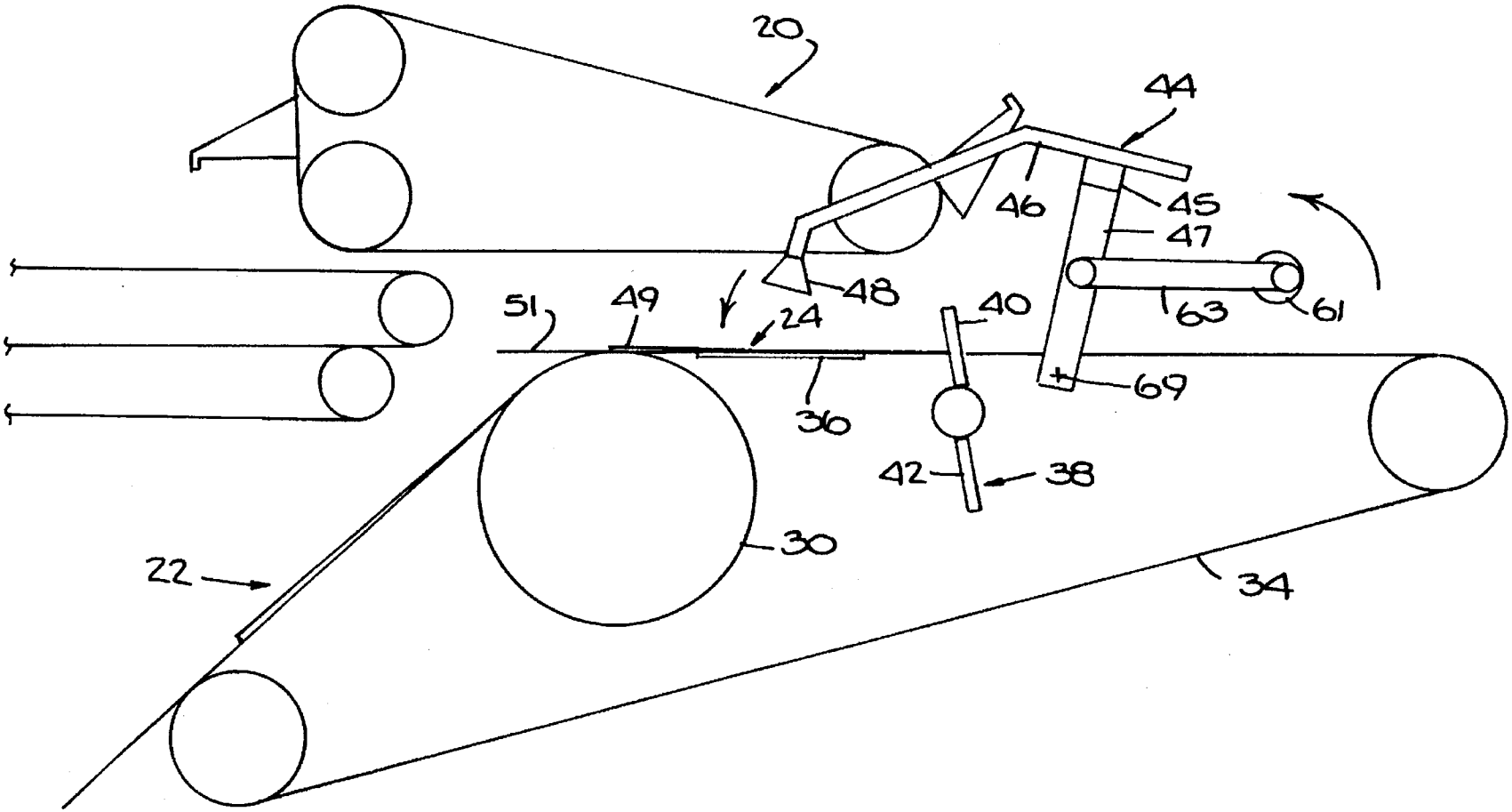
FIG. 1 is a schematic, side elevational view of apparatus for inserting documents into an envelope in accordance with the instant invention, and shows the vacuum cups and supporting bar in the home position.

In describing the preferred embodiment of the instant invention, reference is made to the drawings, wherein there is seen apparatus generally designated 20 for inserting documents 25, also referred to as a "collation," into envelopes 24. The inserting apparatus 20 includes an envelope staging area 22 which consists of a series of laterally spaced roller nips that accept/provide the envelopes 24 from a known location. The staging area 22 is suitably driven in well known manner by a motor via timing pulleys and a belt (not shown). A clutch-brake arrangement may be used instead of the motor.

The envelope inserting apparatus 20 further includes a vacuum drum 30 which supplies valved, vacuum force to its periphery and contains pulleys (not shown) that allow the transport belts 34 to move about its circumference.

The envelope inserting apparatus 20 further includes a vacuum deck 36 having a surface containing a series of vacuum plenums. Each plenum provides a vacuum source to the top of the deck 36 through a series of holes which are straddled by the transport belts 34, which are guided along the top of the deck 36 in specific grooves (not shown). Between each pair of belts 34 is a groove which allows a backstop 38 to protrude above the top of the vacuum deck 36.

The backstop 38 consists of a series of parallel, spaced "two around" fingers 40 and 42 that protrude above the vacuum deck 36 and create a wall against which an incoming envelope 24 will stop.

The inserting apparatus 20 further includes a vacuum bar assembly 44 located above the vacuum deck 36. The assembly 44 includes a support bar 45 traversing the width of the envelope 24 and rigidly secured at each end to a pair of pivotable arms 47 which rotate concentrically about a point 69 located on or near the level of the envelope 24. Clamped to various locations along the width of the support bar 45 are tubes 46 having vacuum cups 48 attached at their far ends. As the entire vacuum bar assembly 44 is pivoted counter clockwise (forward), the vacuum cups 48 descend in such a manner as to contact the back panel 49 of the envelope 24 (whose flap 51 has already been opened). When vacuum force is directed along the tubes 46, the cups 48 grip those back panels 49 which are contacted. The vacuum cups 48 pull up on the back panel 49 when the vacuum bar assembly 44 is pivoted back (clockwise) around its pivot point 69. The foregoing motion causes the throat of the envelope 24 to open when the flap 51 is held in place.

An eccentric crank 61 drives the vacuum bar assembly 44 and causes it to pivot back and forth to grip the back panels and open the throats of the envelopes 24. The eccentric crank 61 is driven by a "smart motor" such as a servo driven stepper motor, DC motor, etc., which in the preferred embodiment is a stepper motor diagramatically shown as 62 in FIG. 1, which drives a link 63 which is secured to one of the pivoting arms 47. As the eccentric crank 61 rotates, the link 63 is driven back and forth causing the support bar 45 to rock forward to a position at which the envelope back panel 49 can be gripped, and then backward causing the throat of the envelope 24 to be opened. The stepper motor 62 is utilized in order to maintain positional control of the eccentric crank 61 during the envelope opening cycle.

Figure 2:
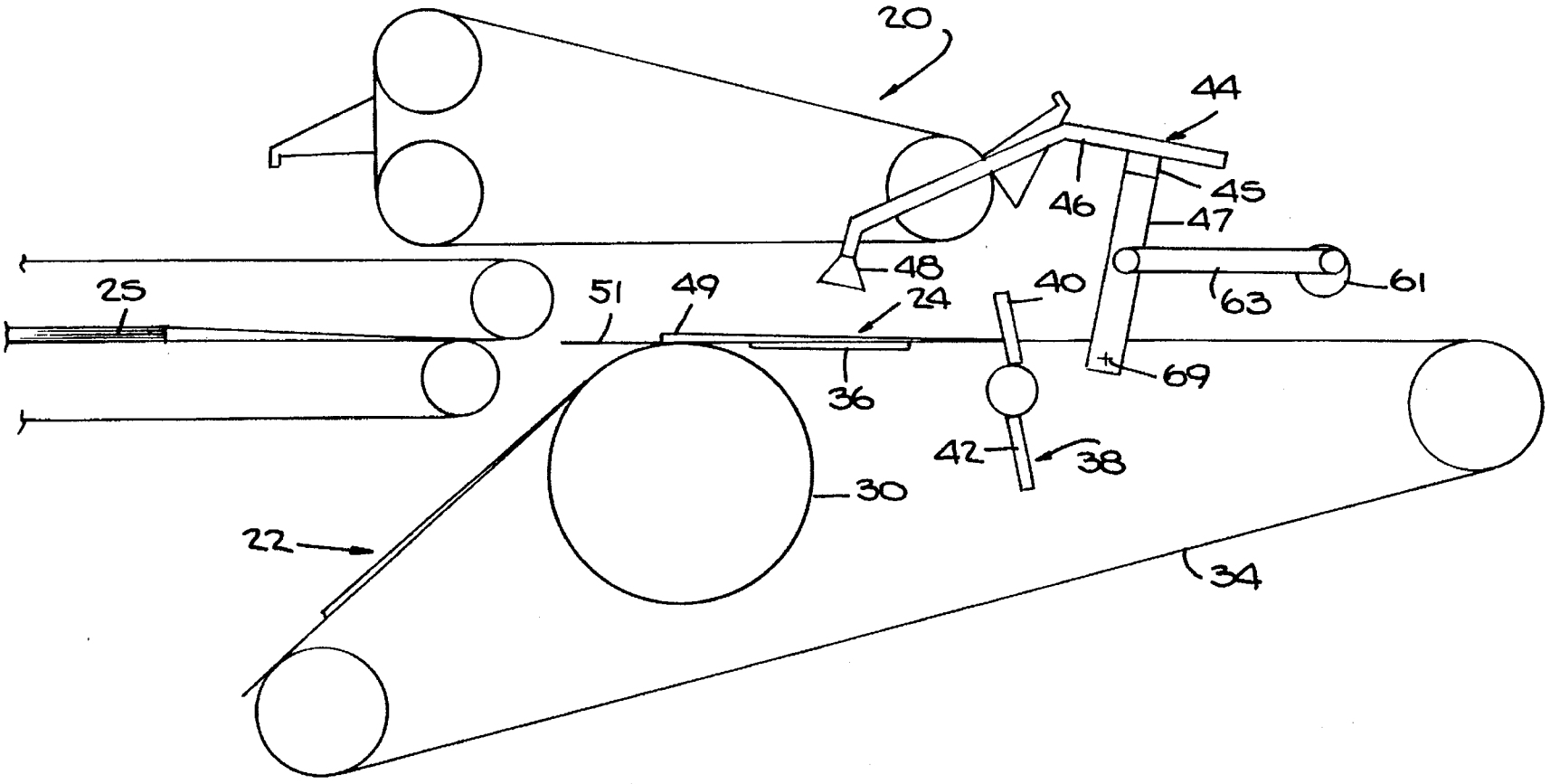
FIG. 2 is similar to FIG. 1 but shows the vacuum cups and supporting bar driven counter clockwise so that the vacuum cups begin to approach the envelope therebelow.
Figure 3:
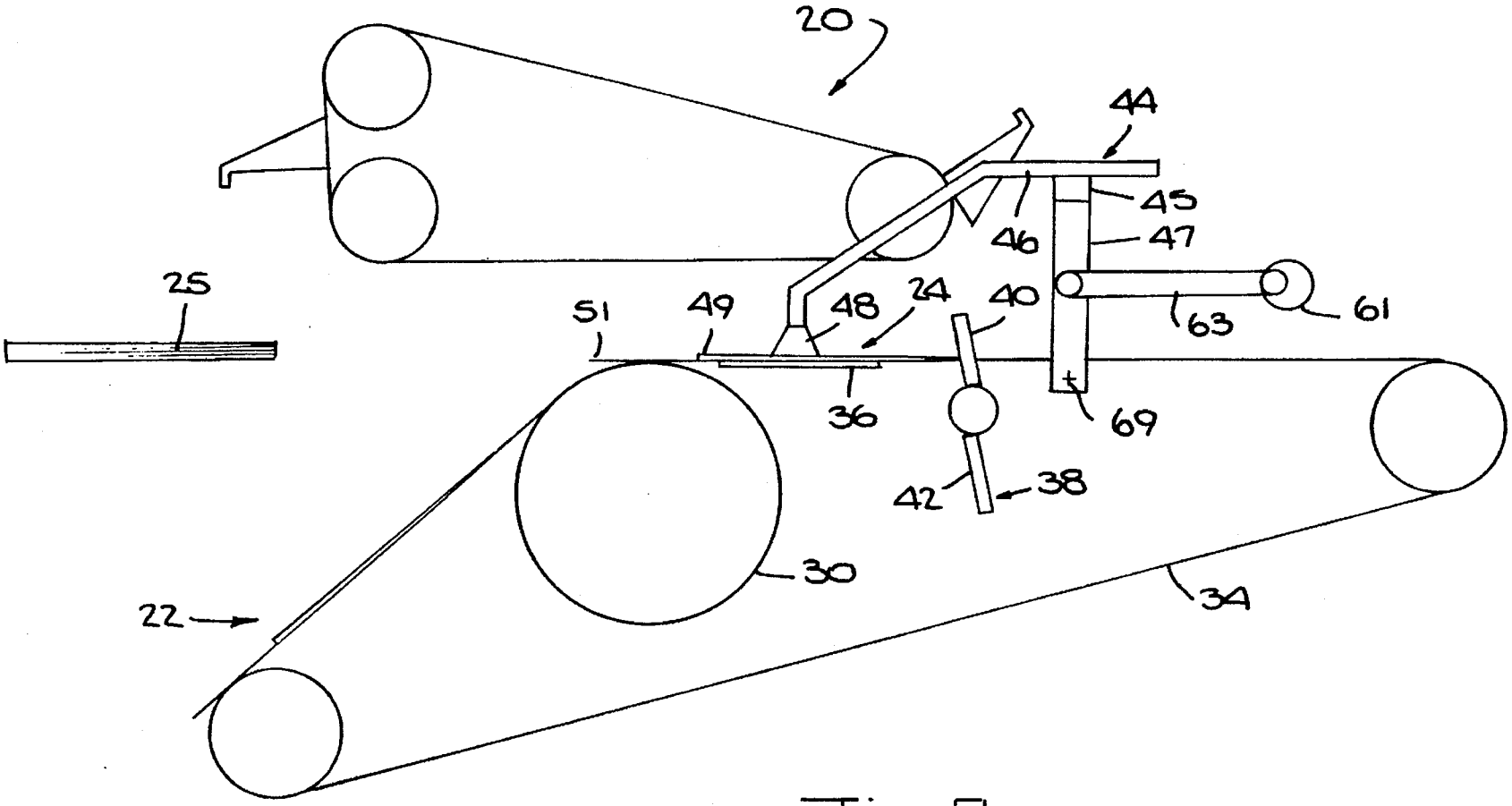
FIG. 3 is similar to FIG. 2 but shows the vacuum cups driven more counter clockwise into contact with the envelope therebelow.

In FIG. 1, the vacuum bar assembly 44 is in its home position with the eccentric crank 61 at the 3 o'clock position (0 degree point). At the appropriate time, the stepper motor 62 drives the eccentric crank 61 in a counter clockwise motion causing the vacuum bar assembly 44 to pivot around the pivot points 69 which causes the vacuum cups 48 to descend toward the waiting envelope 24 as seen in FIG. 2. As the stepper motor 62 continues to drive the eccentric crank 61 toward the 9 o'clock position (see FIG. 3), which is approximately 180 degrees of rotation from the home position, the vacuum cups 48 come into contact with the envelope back panel 49 and vacuum can then be applied through the tubes 46 so that the envelope back panel 49 is gripped by the suction cups 48. As the envelope panel 49 is gripped, the stepper motor 62 continues to drive the eccentric crank 61 past the 9 o'clock position (see FIG. 4) causing the throat of the envelope 24 to be opened. When the desired throat opening has been achieved, the stepper motor 62 stops and the vacuum bar assembly 44 goes into a dwell mode.

Figure 4:
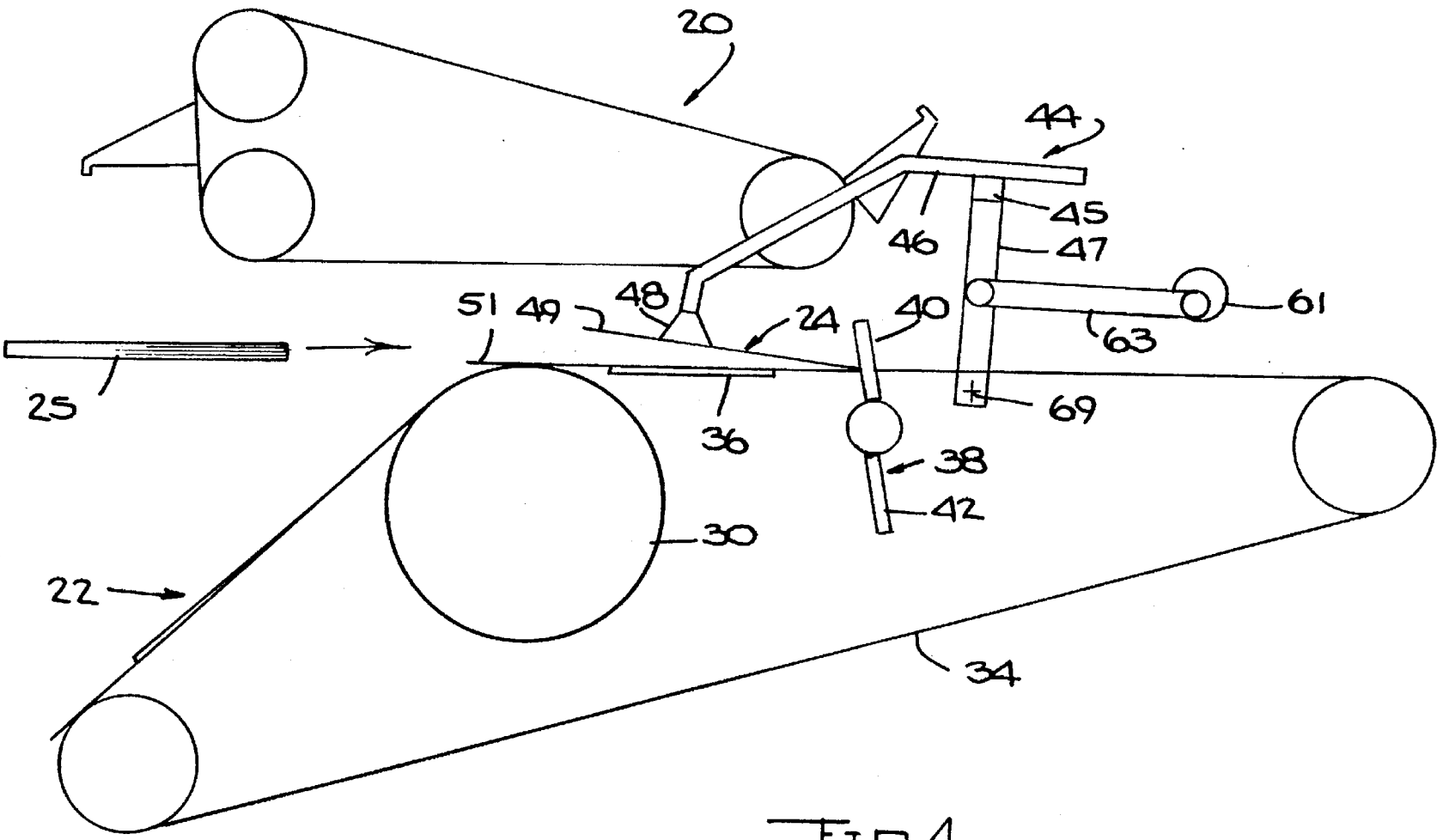
FIG. 4 is similar to FIG. 3 but shows the vacuum cups driven clockwise so that the back panel of the envelope is gripped and the envelope is opened.
Figure 5:
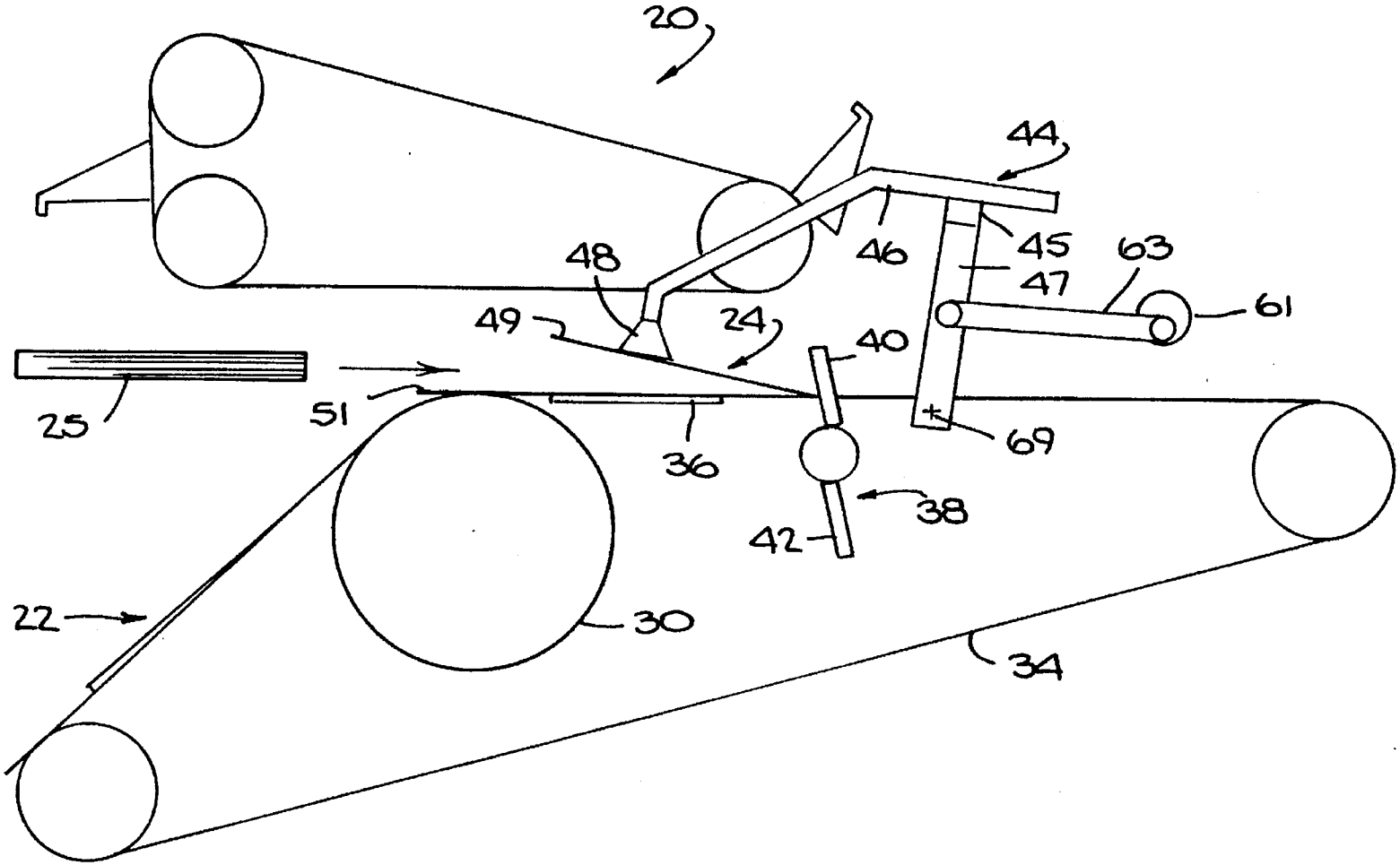
FIG. 5 is similar to FIG. 4 but shows the vacuum cups driven more clockwise to produce a greater opening than that seen in FIG. 4.
Figure 6:
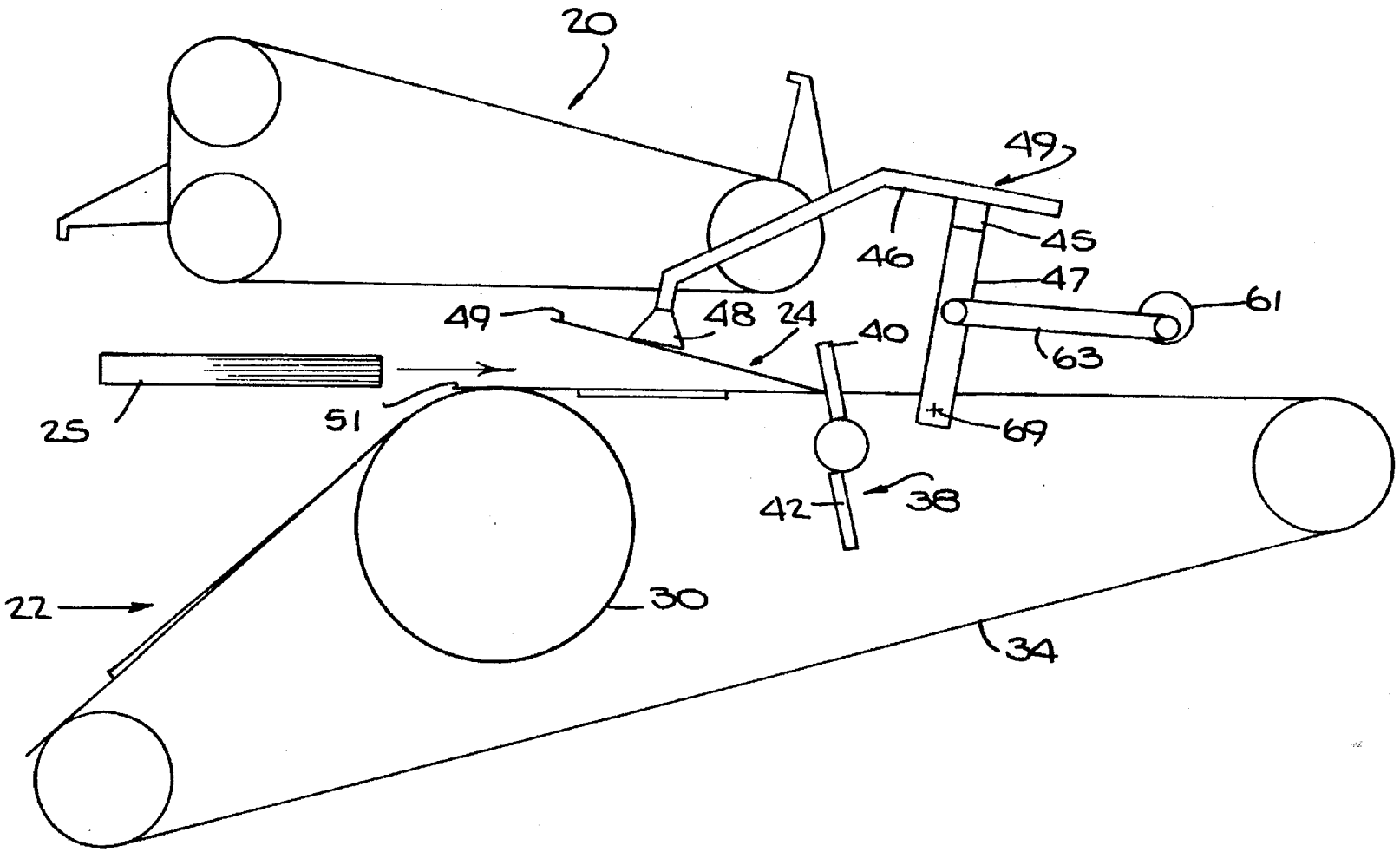
FIG. 6 is similar to FIG. 5 but shows the vacuum cups driven even more clockwise to produce an opening greater than that seen in FIGS. 4 and 5.

With the use of the stepper motor 62, the amount of rotation of the eccentric 61 beyond 180 degrees (i.e., 9 o'clock) may be controlled very accurately, allowing the vacuum bar assembly 44 to open the throat of the envelope 24 within very tight positional tolerances. Moreover the "stroke" or displacement of the vacuum bar assembly 44 can be manipulated and adjusted simply by adjusting the rotation of the stepper motor 62 beyond the 180 degree point. If a particular application required minimal envelope throat opening, the stepper motor would not advance as far beyond 180 degrees (9 o'clock) than it would if a more substantial opening were desired. FIGS. 4–6 depict envelopes 24 that have been opened differing amounts controlled only by the amount of rotation supplied by the stepper motor. FIG. 4 shows the eccentric crank 61 having been rotated to about the 7 o'clock position (approximately 240 degrees from the start) resulting in a distinct envelope opening. FIG. 5 shows the eccentric having been rotated to the 6 o'clock position (approximately 270 degrees from the start) and the envelope throat opening is greater than that seen in FIG. 4. FIG. 6 shows a rotation to approximately 5 o'clock (300 degrees), developing an envelope throat opening greater than that seen in FIGS. 4 or 5. These figures illustrate the manner in which the amount of the envelope throat opening may be varied from envelope to envelope depending upon the application at hand. It should be understood that the magnitude of opening may be adjusted to any position developed by the linkage geometry simply by manipulating the stop position of the stepper motor 62. It is not necessary to adhere to any definitive increments or discrete stop points.

Once the throat of the envelope 24 has been opened and the collation 25 placed in the envelope, the stepper motor 62 may again be energized to return the vacuum bar assembly 44 to is "home" position (eccentric crank 61 at 3 o'clock/0 degree point). During this operation, the vacuum force in the vacuum tubes 46 is valved off and the envelope 24 is free to be transported away for further processing.

Figure 7:
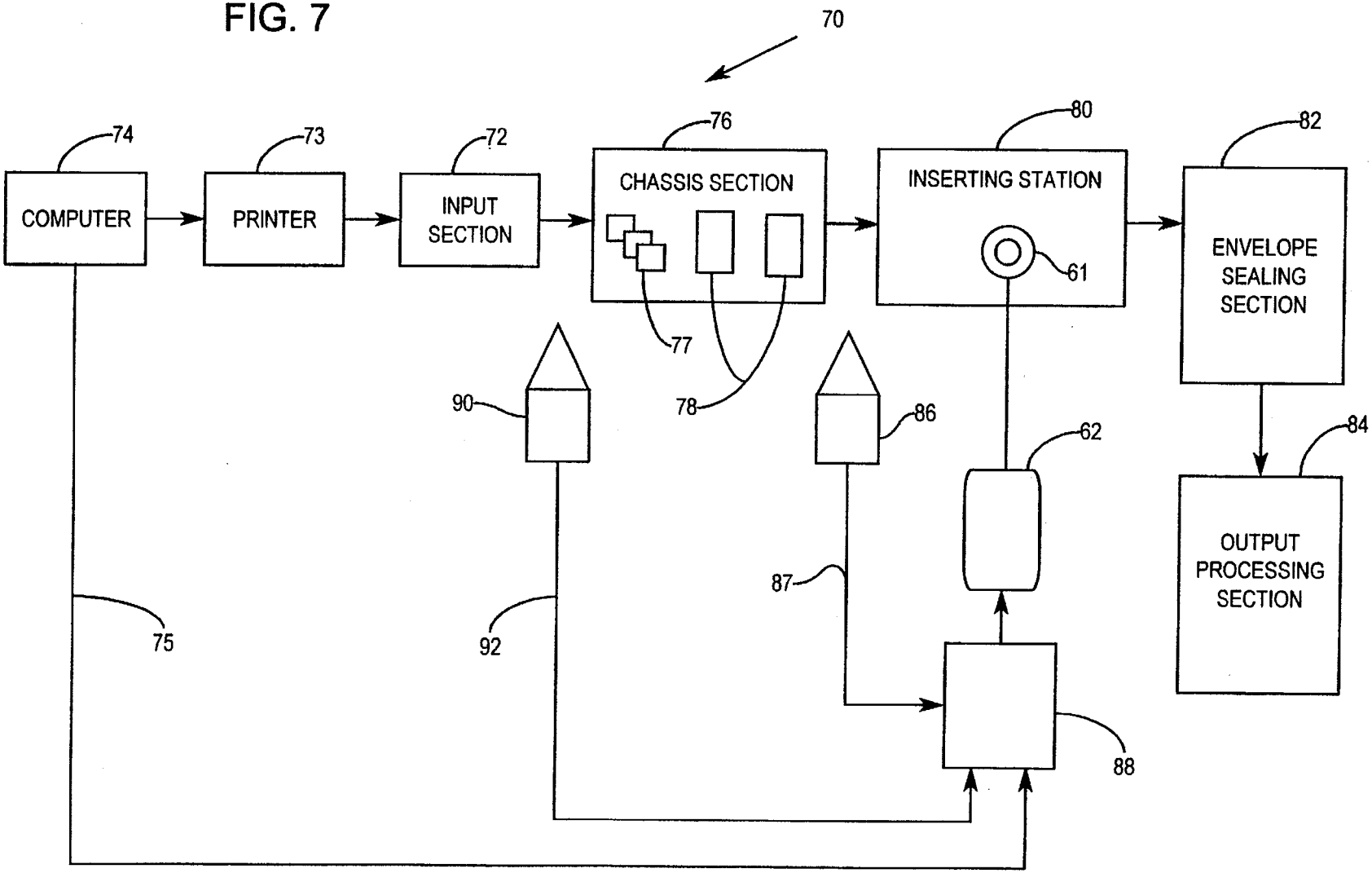
FIG. 7 is a schematic representation of an envelope inserting machine illustrating the apparatus of the present invention.

The envelope inserting apparatus 20 is controlled in such a manner as to open the throats of successive envelopes 24 by an amount which varies from envelope to envelope so as to correspond to the thickness of a collation 25 that is to be inserted into each envelope. This is accomplished by one of the variations of control apparatus shown in FIG. 7, which illustrates in a schematic manner a document inserting and envelope processing machine, indicated generally by the reference numeral 70, of the type in which the envelope throat opening apparatus 20 would be utilized. More particularly, FIG. 7 illustrates two embodiments of apparatus for controlling the amount by which the throats of successive envelopes 24 are opened by a predetermined amount which varies from envelope to envelope depending on the thickness of the collations to be inserted thereinto. It should be understood that FIG. 7 illustrates, and the following description includes, only so much structure of the machine 70 as is necessary for a complete understanding of the present invention Thus, a typical document inserting and envelope processing machine 70 includes an input section 72, which receives document material in either sheet or web form from the printer component 73 of a suitable on board or remote computer 74, which document material eventually becomes the collation 25 to be inserted into an envelope 24. In a typical installation, the document material will be some form of printed data record that is unique to an individual customer, such as his monthly telephone bill which may comprise only a few sheets to a dozen or more depending on the nature of the customer's monthly telephone activity. The input section 72 will typically comprise a sheet or web feeding device which operates in synchronism with the output feeding device of the computer printer 74. If, as is typical, the computer printer 74 prints on a web, the input section 72 of the machine 70 will include a suitable burster or cutter component, both of which are well known in the art and the function of which is to separate discrete sheets of the individual customer from the web.

The document inserting and envelope processing machine 70 also includes a so-called chassis section 76 which includes, firstly, a sheet stacking component that receives the data sheets of the individual customer from the input section 74 and stacks the data sheets into a preliminary collation 77. Alternatively, the input section 74 could include the sheet stacking component, in which case the preliminary collation 77 would be formed in the input section 74 and fed to the chassis section 76. In known manner, the chassis section also includes a suitable feeding mechanism which transports the preliminary collations 77 past a plurality of enclosure feeders 78, which typically add some form of enclosure material to the individual customer data sheet collations 77, such as advertising material, promotion flyers, questionnaire forms, coupons, etc., which are to be included in the final collation 25 that is inserted into an envelope 24 and sent to the customer.

The machine 70 further includes an inserting section 80, which typically would comprise the above described document inserting apparatus 20, as represented diagramatically by the eccentric crank 61 and the stepper motor 62. It should be understood that other arrangements of the foregoing components of the document inserting and envelope processing machine 70 may be utilized within the spirit of the invention. For example, if the collations being inserted comprise only printed sheets and not other forms of enclosure materials, the chassis section can be eliminated. Similarly, if the collations comprise only enclosure materials and not printed sheets, the computer, printer and input sections can all be eliminated. In either case, whatever the collations comprises, it is still measured to determine its thickness so that the envelopes can be opened in the inserting section only the amount required to receive the collations.

Although not forming a part of the present invention, the machine 70 would typically include an envelope sealing section 82, where the flaps of the now filled envelopes are closed and sealed, and an output processing section 84 at which an appropriate postage indicia is added to the envelope, either by direct printing on the envelope or by suitable affixation of a strip of tape on which the postage indicia is printed.

In one embodiment of the invention, the amount by which the throat of an envelope 24 must be opened is determined by a sheet thickness measuring device 86, which is positioned in the machine 70 between the output end of the chassis section 76 and the input end of the insertion section 80. Any suitable form of sheet thickness measuring device may be utilized, providing the device has sufficient sensitivity to be able to distinguish between individual sheets of customer data material. Various forms of such device are known which utilize various measuring techniques, such as mechanical, optical, laser, etc. One suitable type of sheet thickness measuring device is shown in U.S. Pat. No. 4,953,842, issued to Tolmie, et al on Sep. 4, 1990 and assigned to the assignee of this application. For the purpose of the present invention, it is necessary to point out only that the thickness measuring device 86 must be capable of generating data in the form of a signal when a collation is measured which is indicative of the thickness of the collation. Such signal could, for example, be in the form of a mechanical movement or a variable voltage, the extent or intensity, respectively, of which varies with the thickness of the collation. Again, such devices are well known and need not be disclosed in detail for the purpose of understanding the present invention.

Still referring to FIG. 7, it will be seen that the sheet thickness measuring device 86 is suitably coupled, either mechanically or electrically, as the case may be, to a suitable control device 88, which receives the data signal from the sheet thickness measuring device 86, as represented by the line 87, and converts that data into electrical impulses which are transmitted to the stepper motor 62 which drives the eccentric crank 61. Thus, it will be seen that as each collation 25 is formed and fed from the chassis section 76 to the insertion section 82, it is measured by the thickness measuring device 86 which generates data indicative of the thickness of the collation in the form of a mechanical or electrical data signal and sends that data signal to the control device 88 which, in turn, converts the signal to an appropriate number of electrical pulses to rotate the stepper motor 62 an appropriate amount to cause the suction cups 48 to open the throat of the envelope 24 by a predetermined amount which is sufficient to accept the collation 25 and which will vary from envelope to envelope in accordance with the thickness of each successive collation 25. As previously stated, this avoids any unnecessary stress on the front and back panels of the envelope 24 by preventing distortion of the envelope panels beyond that which is necessary to open the throat of the envelope enough to receive the collation intended for that envelope.

In a further embodiment of the invention, the above described physical thickness measuring system is replaced by a calculated thickness measuring system in which the thickness of each or a series of collations is calculated prior to formation of the collation in the chassis section 76. This is accomplished by taking advantage of various physical characteristics of the collation which are known prior to formation of the collation, such as the number of sheets of paper on which unique customer data is printed, the thickness of the paper, the number of folds that may be imparted to each sheet of paper, the number of miscellaneous inserts that are to be added to the customer data sheets and the thickness of each of the miscellaneous inserts. It will be apparent that with a machine of the type under consideration, which is intended primarily for very high volume mailings of the type previously described, it becomes both practical and cost effective to enter all of this data into the computer 74. By well known technology, the computer 74 has the capability through appropriate software of calculating the precise thickness of any individual collation, or any series of identical collations together with the number of such identical collations.

The computer 74 further has the capability through known technology of generating a data signal in appropriate form that is indicative of the thickness of the collations and transmitting this signal, as represented by the line 75 to the same or similar control device 88 which received data signals from the thickness measuring device 86 utilized in the previously described embodiment of the invention. In this embodiment, the control device 88 then performs the same function as described above in connection with the physical thickness measuring device 86 to convert the incoming data signal into electrical pulses which rotate the stepper motor an appropriate amount to open the throats of envelopes by an amount sufficient to receive the collations intended for that envelope.

In an alternate form of this embodiment, the computer 74 includes the capability of adding bar code thickness data to a bar code already printed on at least the first customer data sheet which contains other relevant information to handling the customer data sheets. The machine 70 will then include a suitable reader 90, such as a bar code reader, which may be inserted into the machine 70 between the input section 72 and the chassis section 76 as shown, or between the printer 73 and the input section 76, whichever is more convenient. The bar code reader 90 reads the bar code thickness data printed on the first customer data sheet and converts this information into the aforementioned collation thickness data signal that is transmitted, as indicated by the line 92, to the control device 88, which then performs the same function in response to this signal are previously described. The advantage of utilizing printed bar code data to transmit the thickness data to the control device 88 as distinguished from transmitting the data directly from the computer is that a bar code is already present and little effort or physical facility is necessary to add collations thickness data to that bar code.

From the foregoing description, it should now be apparent that the physical and calculated collation thickness measuring systems, together with the control device responsive to the collation thickness data signal, provide a simple, positive method of opening an envelope 24 with fine adjustment for a wide range of envelope types. The described system provides the ability to optimize the opening of the envelopes 24 to only what is necessary to insert a given collation, which minimizes mechanical motion and distortion of the envelope during the insertion process. Thus, the reliability of the insertion process is increased.

It should be understood by those skilled in the art that various modifications may be made in the present invention without departing from the spirit and scope thereof, as described in the specification and defined in the appended claims.

What is claimed is:

1. In an inserting machine having means for opening the throats of successive envelopes fed to an inserting location and means for inserting a collation into each opened envelope, apparatus for ascertaining the thickness of successive collations and for opening the throats of successive envelopes a predetermined amount that varies from envelope to envelope in accordance with the thickness of the collation to be inserted into the envelopes, said apparatus comprising:

A. means for supporting successive envelopes at an inserting location,

B. movable vacuum means disposed at said inserting location for opening said envelopes, C. actuator means for moving said vacuum means to open said envelopes, D. means for ascertaining the thickness of successive collations to be inserted into successive envelopes supported at said inserting location and for generating data indicative of the thickness of each successive collation, and E. control means responsive to said data for controlling said actuating means to open said successive envelopes a predetermined amount which varies in accordance with the thickness of said successive collations, whereby each successive envelope supported at said inserting location is opened a predetermined amount depending on the thickness of the collation to be inserted into a particular envelope.

2. Apparatus as set forth in claim 1 wherein said actuator means comprises a stepper motor connected to said vacuum means for moving said vacuum means a predetermined increment of movement in response to a predetermined increment of rotation of said stepper motor.

3. Apparatus as set forth in claim 2 wherein said means for ascertaining the thickness of said successive collations includes means for generating data indicative of the thickness of said successive collations and for transmitting said data to said control means.

4. Apparatus as set forth in claim 3 wherein said control means comprises processor means for converting said data generated by said means for ascertaining the thickness of said successive collations into electrical pulses capable of driving said stepper motor through a number of increments of rotation sufficient to move said vacuum means a predetermined distance to open successive envelopes only an amount required to accept the collations to be inserted to said successive envelopes.

5. Apparatus as set forth in claim 4 wherein said means for ascertaining the thickness of said successive collations comprises means for measuring the physical thickness of said collations prior to said collations being inserted into said envelopes.

6. Apparatus as set forth in claim 5 wherein said means for ascertaining the thickness of said successive collations comprises computer processing means for calculating the thickness of said successive collations from data previously stored in said computer processing means indicative of various characteristics of said successive collations.

7. Apparatus as set forth in claim 6 wherein said computer processing means includes means for printing an indicia on at least one sheet of each of said successive collations that is indicative of the thickness of said collations.

8. Apparatus as set forth in claim 7 wherein said means for ascertaining the thickness of said collations further includes a reader capable of reading said indicia.

9. A method of ascertaining the thickness of successive collations and for opening successive envelopes a predetermined amount that varies from envelope to envelope in accordance with the thickness of the collation to be inserted into the envelopes, said method comprising the steps of:

A. supporting successive envelopes at an inserting location,

B. moving a vacuum means disposed at said inserting location into contact with the back panels of said envelopes for acquiring said back panels of said envelopes, C. ascertaining the thickness of successive collations to be inserted into successive envelopes supported at said inserting location and generating data indicative of the thickness of each successive collation, and E. moving said vacuum means away from said envelopes by a predetermined amount which varies from envelope to envelope in accordance with the data indicative of the thickness of said successive collations, whereby each successive envelope supported at said inserting location is opened a predetermined amount depending on the thickness of the collation to be inserted into a particular envelope.

* * * * *